US008551293B2

(12) United States Patent
Faufau et al.

(10) Patent No.: US 8,551,293 B2
(45) Date of Patent: Oct. 8, 2013

(54) METHOD AND MACHINE FOR MANUFACTURING PAPER PRODUCTS USING FOURDRINIER FORMING

(75) Inventors: James Faufau, Alpharetta, GA (US); Andrew Forester, Schoolcraft, MI (US)

(73) Assignee: IBS Corp., Chesapeake, VA (US)

( * ) Notice: Subject to any disclaimer, the term of this patent is extended or adjusted under 35 U.S.C. 154(b) by 0 days.

(21) Appl. No.: 13/506,470

(22) Filed: Apr. 21, 2012

(65) Prior Publication Data

US 2012/0267065 A1 Oct. 25, 2012

Related U.S. Application Data

(60) Provisional application No. 61/517,613, filed on Apr. 21, 2011.

(51) Int. Cl.
*D21F 11/00* (2006.01)

(52) U.S. Cl.
USPC ..... 162/208; 162/209; 162/348

(58) Field of Classification Search
USPC ..... 162/348, 208, 209, 356, 352, 374
See application file for complete search history.

(56) References Cited

U.S. PATENT DOCUMENTS

| | | | | |
|---|---|---|---|---|
| 3,573,159 | A * | 3/1971 | Sepall | 162/208 |
| 3,922,190 | A * | 11/1975 | Cowan | 162/352 |
| 4,838,996 | A * | 6/1989 | Kallmes | 162/352 |
| 5,169,500 | A | 12/1992 | Mejdell | |
| 5,830,322 | A * | 11/1998 | Cabrera y Lopez Caram et al. | 162/209 |
| 5,922,173 | A * | 7/1999 | Neun et al. | 162/352 |
| 5,951,823 | A * | 9/1999 | Cabrera Y Lopez Caram et al. | 162/352 |
| 6,030,501 | A * | 2/2000 | Neun et al. | 162/352 |
| 6,988,018 | B2 * | 1/2006 | Eames | 700/129 |
| 7,993,492 | B2 * | 8/2011 | Cabrera Y Lopez Caram | 162/211 |
| 2003/0116295 | A1 * | 6/2003 | Eames | 162/199 |
| 2005/0150627 | A1 * | 7/2005 | Frawley et al. | 162/352 |
| 2011/0186254 | A1 * | 8/2011 | Cabrera Y Lopez Caram | 162/190 |
| 2013/0042987 | A1 * | 2/2013 | Cabrera Y Lopez Caram | 162/208 |

FOREIGN PATENT DOCUMENTS

WO WO 2007/088456 * 8/2007

OTHER PUBLICATIONS

Pruitt, M., "How fourdrinier table control affects strength and speed on linerboard—Green Bay Packaging's Morriton, AR, mill" Nov. 30, 2008, available at: http://www.risiinfo.com/magazines/November/2008/PP/PPMagNovember-How-fourdrinier-table-control-affects-strength-and-speed-on-linerboard.html, last accessed Mar. 20, 2013.

* cited by examiner

*Primary Examiner* — Mark Halpern
(74) *Attorney, Agent, or Firm* — The Dobrusin Law Firm, P.C.

(57) ABSTRACT

An improved method for producing paper from pulp includes a plurality of subassemblies arranged in the forming or wet section of a Fourdrinier. The Fourdrinier includes a dewatering table having a plurality of blades that are static and on-the run adjustable in height and/or angle to control orientation of paper fibers in the stock to create a superior quality of paper and improved paper strength characteristics. Gravity and vacuum assisted drainage elements are equipped with on-the-run adjustable angle and height dewatering foil blades starting from a paper dryness of 0.1% and extending all the way to 5% dryness. The result of this process and machine is to improve the paper quality, save fibers and chemicals and fulfill the required paper properties.

13 Claims, 9 Drawing Sheets

METHOD AND MACHINE FOR MANUFACTURING PAPER PRODUCTS USING FOURDRINIER FORMING

The present application relates to U.S. Provisional Patent Application Ser. No. 61/517,613 filed on Apr. 21, 2011 and claims priority therefrom.

The present application was not subject to federal research and/or development funding.

TECHNICAL FIELD

Generally, the invention relates to a method and machine for dewatering and forming a paper slurry. More specifically, the invention is a process and machine which produces paper having more uniform fiber orientation, sheet structure and improved paper strength characteristics. The improved method and machine includes devices that are arranged in the forming or wet section of a Fourdrinier machine, hereinafter referred to as "Fourdrinier." The devices are adjusted manually or through a computer and associated drive mechanisms.

An improved method of forming paper using a Fourdrinier is composed of a plurality of foil and vacuum assisted drainage elements that are equipped with on-the-run adjustable angle and/or height dewatering foil blades starting from a paper dryness of 0.1% and extending all the way to 5% dryness within the forming section of a Fourdrinier. The foil blade angle, height, and vacuum level are adjusted as applicable along the entire length of the Fourdrinier dewatering table until a paper dryness of 5% is achieved. These adjustments allow for control of the dewatering rate and turbulence (shear) produced from a paper dryness of 0.1% to 5% on the Fourdrinier dewatering table. Controlling drainage and shear along this entire range of dryness has a direct influence on paper fiber orientation. This has a significant influence on paper strength.

The claimed invention works in unison with the paper machine headbox shear forces to promote maximum fiber orientation in either the cross-machine or machine direction orientation of the paper. The headbox controls fiber orientation through a speed difference between its stock jet speed and the dewatering fabric speed. Once the stock jet lands on the dewatering fabric, it is operated at an overspeed compared to the dewatering fabric "rush" or the same speed "square" or an underspeed "drag" to control the orientation of the fibers during the sheet forming process. Operating the headbox in a rush or drag mode will align fibers in the machine direction which is beneficial for machine direction related strength properties in the finished paper product. Operating in a square mode will produce a maximum cross-machine direction fiber orientation of the fibers in the finished paper product which is beneficial for paper strength properties in the cross-machine direction.

The claimed invention provides control of drainage and turbulence anisoptropic shear after the headbox stock jet lands on the dewatering fabric. After the stock lands, the claimed invention is adjusted to preserve or amplify the fiber orientation characteristics produced by the headbox. In this manner, a higher quality of paper is produced. Moreover, existing machines may be retrofitted with various devices and operated in the manner disclosed herein to achieve a superior quality of paper stock.

For example, if machine direction fiber orientation is desired, the headbox jet speed is operated in a rush or drag mode to promote an initial strong machine direction alignment of the paper fibers. From here, the foil blade angles and height, along with the vacuum levels on the vacuum assisted dewatering units are adjusted to produce a high early drainage rate in the initial sheet dewatering zone (0.1% to 2% paper dryness) to immediately freeze the machine direction fiber orientation produced by the headbox. In addition to this, the foil blade angles, heights and vacuum levels are also adjusted to produce a high amount of turbulence in this paper dryness zone (0.1% to 2%). This keeps the fibers mobile and prevents entanglement allowing the headbox shear to become more effective in orientating fibers in the machine direction. After 2% paper dryness, the angle and height and vacuum levels are adjusted to gradually achieve a paper dryness of 5%. However, the foil angle and height are adjusted to achieve only moderate turbulence levels to prevent disruption of the machine direction fiber orientation achieved earlier in the sheet dewatering and forming process.

For cross-machine direction fiber alignment, the process is completely reversed. The headbox stock jet is adjusted to produce a speed difference close to zero (square mode) to promote the highest possible cross-machine direction fiber orientation. However, due to contraction created within the headbox nozzle, a certain unavoidable degree of machine direction fiber alignment is still always present in the fiber slurry when it lands on the dewatering fabric that cannot be reversed through normal Fourdrinier dewatering equipment. To break this natural machine direction fiber orientation up and produce the most random fiber orientation and highest amount of cross-machine direction fiber orientation, the claimed invention is operated as follows. First, the foil blade angles and heights along with the vacuum levels of the vacuum assisted dewatering elements are adjusted to significantly retard drainage in the early sheet forming zone (0.1% to 2% dryness). This is completely opposite of the previously described process for machine direction fiber orientation. In addition to this, the angle and height of the foil blades are adjusted to produce a very high degree of turbulence to prevent fiber entanglement and generate the most random fiber orientation possible for the highest level of cross-machine direction fiber alignment. After a dryness of 2% is achieved, the foil angle and height is adjusted to maintain this high level of turbulence all the way until a paper dryness of 5% is achieved. A very gentle early drainage along with high turbulence all the way until a dryness of 5% will create the most random fiber network resulting in the highest amount of cross-machine direction fiber alignment.

The ability of the claimed process and machine improvement to be adjusted in conjunction with shear significantly increases paper sheet strength properties such as Mullen, Burst, Bending Stiffness, or Concora (machine direction strength properties) and Ring Crush, S.T.F.I, SCT (cross machine direction strength properties) and all other strength properties associated with paper manufacturing.

In addition to this, the claimed invention and sheet forming process also improves other paper properties such as formation, smoothness, uniformity, printability, ply bond strength, and the like.

BACKGROUND OF THE INVENTION

The forming or wet section of a Fourdriner consists mainly of the head box and forming wire. Its main purpose is to generate consistent slurry, or paper pulp, for the forming wire. Several foil, suction boxes, a couch roll, and a breast roll commonly make up the rest of the forming section. The press section and dryer section follow the forming section to further remove water from the stock.

Historically, the main tools used to control paper strength have been fiber species and fiber refining energy along with the orientating shear generated by the speed difference between the headbox jet speed and the dewatering (forming) fabric speed. The first method of continuous sheet forming and dewatering was the Fourdrinier dewatering table which is still the dominant tool used for paper manufacturing today. Since the time of its invention, its impact on sheet strength has been misunderstood or vaguely understood. Also, the ability to directly influence sheet strength through changing the drainage or shear rates produced during the Fourdrinier dewatering and forming process have also been misunderstood. Past technologies such as the VID, Deltaflo or Vibrefoil have been able to adjust drainage and turbulence on the Fourdrinier table. However, these technologies have been used prior to a sheet consistency on the Fourdrinier table of 1.5% or less. The impetus behind their design was simply to generate turbulence in a very short area in an effort to improve paper uniformity (formation) which was claimed to influence sheet strength.

It has been discovered through the use of the claimed improved Fourdrinier papermaking process that controlling drainage and turbulence from a paper dryness of 0.1% to 5% on a dewatering table has a far more significant impact of fiber orientation and paper strength. In addition, the previously described methods of adjusting the headbox shear in conjunction with adjusting drainage and turbulence in this zone to control fiber orientation and paper strength up to this point been has been unknown to anyone other than the inventors of the claimed improved process.

BRIEF SUMMARY OF THE INVENTION

An improved process of Fourdrinier papermaking is used for dewatering and paper quality control and achieved in the forming end of the Fourdrinier. The process uses a plurality of gravity and vacuum assisted drainage elements that are equipped with on-the-run adjustable angle and height dewatering foil blades starting from a paper dryness of 0.1% and extending all the way to 5% dryness. The foil blade angles and heights along with vacuum level are adjusted manually or automatically along the entire length of the Fourdrinier dewatering table until paper dryness of 5% is achieved.

The claimed invention uses a series of gravity assisted drainage elements in the beginning of the Fourdrinier dewatering table. These units are the forming board and hydrofoil section that are equipped with a combination of static and adjustable angle foil blades, as well as foil blades which are height adjustable depending on the paper grade being produced. A low-vacuum section is arranged on the dewatering table after the hydrofoil section. The low-vacuum section includes vacuum assisted drainage elements which are equipped with vacuum control valves, fixed angle and angle adjustable foil blades, as well as foil blades which are height adjustable depending on the paper grade being produced. A high-vacuum section is arranged between the low-vacuum section and a couch roll.

Adjusting the angle and height of the dewatering foil blades along with the vacuum level allows for control of the dewatering rate and turbulence (shear) produced from a paper dryness of 0.1% to 5% on the Fourdrinier dewatering table. Controlling drainage and shear along this entire range of dryness in conjunction with fiber orientation shear produced by the headbox has a direct influence on paper fiber orientation. This has a significant influence on paper strength.

Adjustable dewatering technologies are typically used on the Fourdrinier table in an area directly after the forming board or within a short distance of the forming board and dewater the stock only to a dryness content of around 1.5% Previously, the design and operation of adjustable dewatering technologies has not been focused on fiber orientation control to improve sheet strength. Also, no previous adjustable dewatering technologies have ever been use at a dryness level greater than 2%.

Other technologies such as the dandy roll or top dewatering machines have been used at a dryness content of 1.5% or greater. However, their purpose has simply been water removal or paper formation improvement, not fiber orientation control liked the claimed invention. Moreover, none of the existing technologies are directed towards precisely controlling fiber orientation as in the disclosed manner.

It is an object of the invention to disclose an improved process for controlling the fiber orientation of paper stock to achieve a better quality paper than is currently produced on a Fourdrinier.

It is a further object of the invention to teach a Fourdrinier having adjustable on-the-run mechanisms for adjusting the height and angle of foils or blades to easily switch over operation of the Fourdrinier to produce paper of higher quality through controlling the orientation of the fibers.

Additional objects and advantages of the invention will be set forth in part in the description which follows, and in part will be obvious from the description, or may be learned from practicing the invention. The objects and advantages of the invention will be obtained by means of instrumentalities in combinations particularly pointed out in the appended claims.

BRIEF DESCRIPTION OF THE SEVERAL VIEWS OF THE DRAWING

Other objects and purposes of this invention will be apparent to person acquainted with apparatus of this general type upon reading the following specification and inspecting the accompanying drawings, in which.

DETAILED DESCRIPTION OF THE INVENTION

Figure 1:
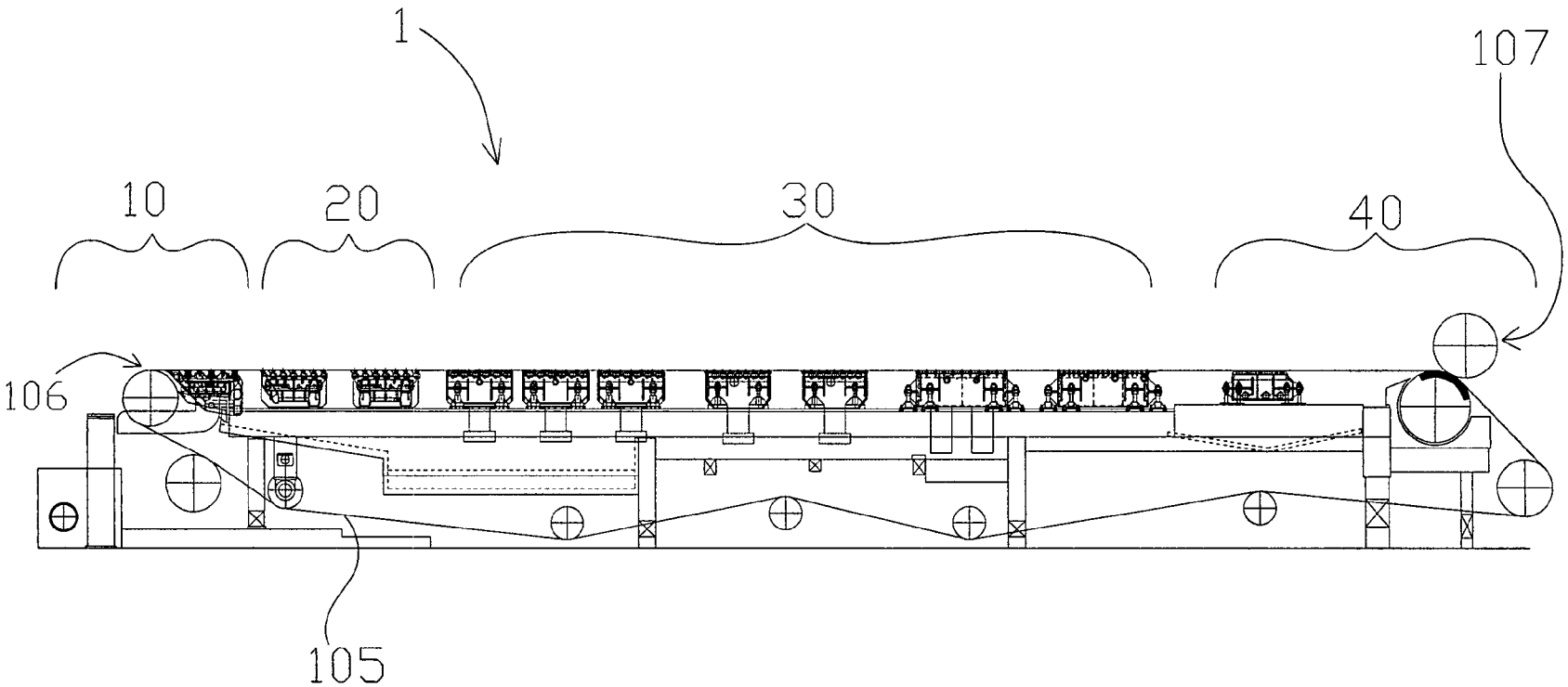
FIG. 1 illustrates a Fourdrinier papermaking machine incorporating the present invention therein.

The embodiments of the invention and the various features and advantageous details thereof are more fully explained with reference to the non-limiting embodiments and examples that are described and/or illustrated in the accompanying drawings and set forth in the following description. It should be noted that the features illustrated in the drawings are not necessarily drawn to scale, and the features of one embodiment may be employed with the other embodiments as the skilled artisan recognizes, even if not explicitly stated herein. Descriptions of well-known components and techniques may be omitted to avoid obscuring the invention. The examples used herein are intended merely to facilitate an understanding of ways in which the invention may be practiced and to further enable those skilled in the art to practice the invention. Accordingly, the examples and embodiments set forth herein should not be construed as limiting the scope of the invention, which is defined by the appended claims. Moreover, it is noted that like reference numerals represent similar parts throughout the several views of the drawings.

For illustrative purposes only, the invention will be described in conjunction with a Fourdrinier papermaking machine although the invention and concept could also be applied to hybrid and gap formers. The invention is implemented in the wet section of the Fourdrinier and includes a forming board section 10, a hydrofoil section 20, and a low-vacuum section 30. High-vacuum section 40 does not include automatically adjustable height blades or automatically angle adjustable blades. It should be noted that a headbox is known and is therefore not shown in FIG. 1. Referring now to FIG. 1, a Fourdrinier comprises a forming fabric 105, a breast roll 106 and couch roll 107. The forming fabric is continuous and travels between the breast and couch rolls 106, 107. The stock which comprises pulp fibers is deposited from the headbox to the top surface of the forming fabric 105 at a paper dryness ranging from 0.1% to 1%. Immediately following the headbox, the forming fabric passes over a forming board section 10 which comprises a formline element 11.

Figure 2:
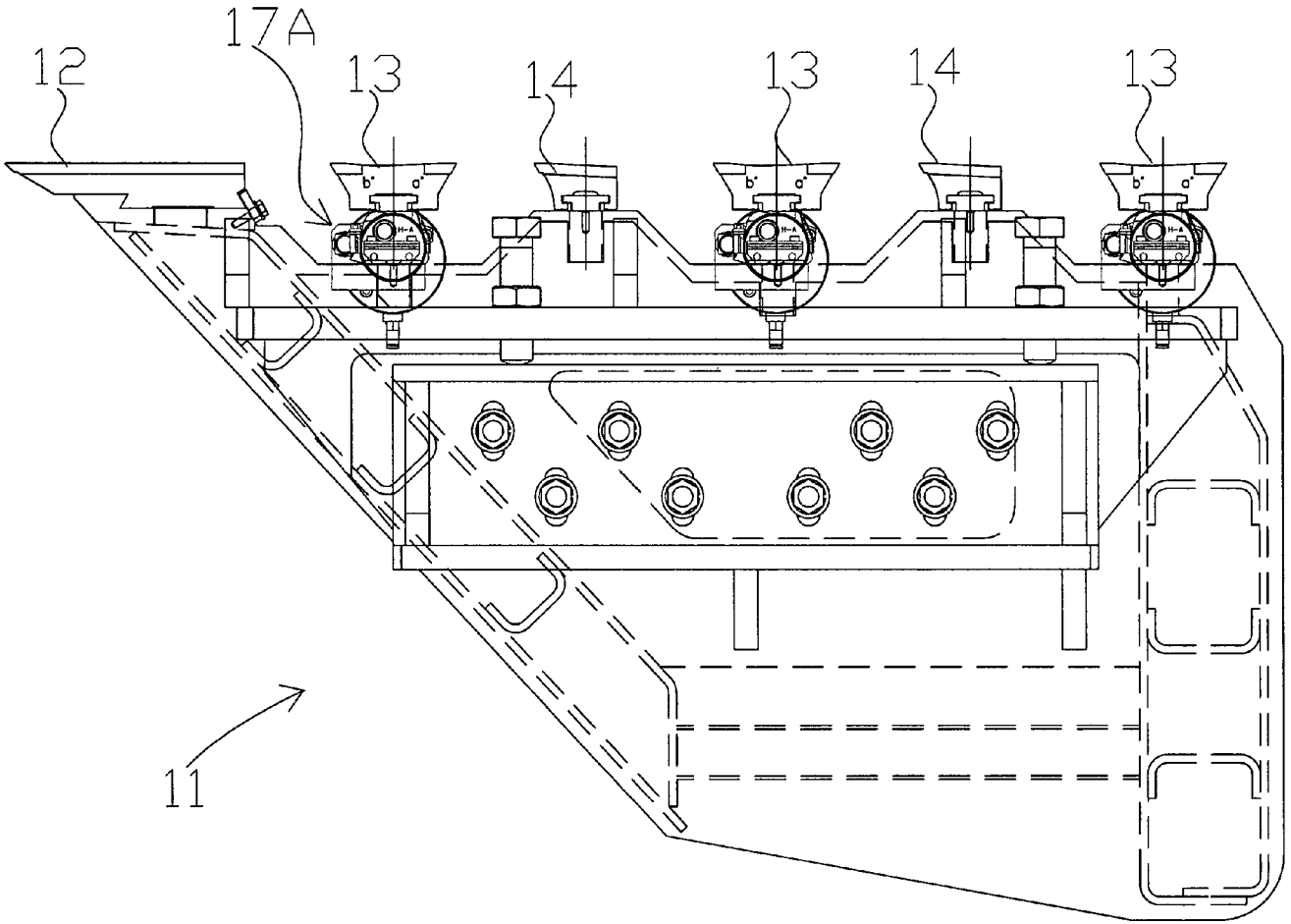
FIG. 2 is an enlarged view showing a formline element with stationary and adjustable height foil blades and which forms part of the forming board section of the Fourdrinier.

As shown in FIGS. 1 and 2, the forming board section 10 includes formline element 11 which includes a fixed ceramic lead blade 12 and a plurality of trailing blades 13, 14. The blades 13, 14 are arranged beneath the forming fabric or wire and are fixed atop either stationary or adjustable C-bar or T-bar which extend from one side of the Fourdriner to the other. The support bars preferably comprise fiber reinforced composite. The stationary bars are fixed. In the preferred embodiment, the formline element 11 includes three adjustable trailing blades 13 which may be raised and lowered or the angle adjusted as shown in the respective figures with the use of respective drive 17A. The drives are arranged at opposite ends of a support bar and fixed. The drives arranged at opposite ends of the support bar operate in concert to lower or raise a respective blade. It should be noted that the air, hydraulic and electrical lines for actuating the drives are not shown for ease in understanding the drawings. It should be understood that it is contemplated that various other drives, pistons or motors including electric and hydraulic ones and their associated supply lines may be employed to practice the invention. The adjustable blades 13 are raised or lowered to cause them to intersect the underside of the forming fabric 105 at a predetermined height to influence the alignment of the fibers within the paper web. Two fixed trailing blades 14 are arranged between the height adjustable blades 13, as shown. In a preferred embodiment, the height of the adjustable blades may be changed to ensure that the paper fibers are aligned in a desired direction. The forming board lead blade 12 is arranged near the breast roll and is stationary. A plurality of forming board trailing blades is arranged in an alternating sequence of adjustable height blades 13 and stationary blades 14. The forming board trailing blades preferably comprise ceramic.

During this stage, some water is drained from the stock and a very thin wet sheet is carried over to various other dewatering devices such as foil blades in hydrofoil section 20, until a sheet paper dryness of around 1% to 1.5% is achieved. Following this, the paper dryness is increased by the foil blades in the Varioline and Vaculine in the low vacuum section 20 to a dryness level of 5%. Next, a paper dryness of 8% to 10% is achieved in the elements of the low-vacuum section 30 and the sheet is transferred to the high-vacuum section 40 to achieve a paper dryness of 18% or greater. Finally, the sheet is transferred over the couch roll where additional dryness level is achieved.

A Fourdrinier composed of the previously described equipment is fitted with a plurality of adjustable angle and height foil blades starting from the forming board section 10 and partially through the low-vacuum section 30. As the stock travels with the forming fabric 105, it encounters the adjustable angle and height foil blades at various points along the dewatering table to manipulate the paper web and orient more fibers in a desired direction. On the forming board section 10 and the hydrofoil or gravity section 20, the adjustable angle foil blades generate a vacuum pulse that dewaters the stock slurry. The amount of drainage produced along each adjustable angle foil blade is determined by the angle setting of the foil blade which can be typically varied between +2 and −4 degrees. A higher angle will produce more drainage.

Also within the forming board section and hydrofoil or gravity section of the papermaking process, the stock encounters adjustable height foil blades. These blades also drain water from the stock slurry. The amount of water drained by the adjustable height foil blades is determined by their height setting in relation to the forming fabric. At a setting of −5 mm, they do not touch the fabric and do not drain any water. At a setting of 0 mm, they are in the same plane as the forming fabric and will drain water. As the adjustable height foil blades are lowered from the fabric, the amount of drainage increases up until a point at which the static and dynamic vacuum forces generated by the adjustable height foil blade are overcome by the tension forces of the forming fabric. When this occurs, the fabric breaks its seal with the adjustable height foil blade and no dewatering occurs. The setting at which this occurs will vary based on the drainage characteristics of the stock, the stock consistency, and the speed of the forming fabric. As can be understood, changing the height settings will directly influence the fiber orientation.

The wet slurry will leave the hydrofoil section 20 at a consistency of around 1.5% depending on the paper grade and speed. From here, it travels to the initial vacuum assisted foil units in the low-vacuum section 30 which are referred to as the Varioline elements. In addition to natural gravity drainage, these Varioline elements also use a dynamic and an external vacuum source to create a vacuum which is drawn onto the lower side of the forming fabric 105. This further increases drainage within these units. The Varioline elements are equipped with a plurality of stationary and adjustable height foil blades. Similar to the previous section, as the foil blades are lowered from the forming fabric, the drainage rate increases as discussed above.

Following the Varioline table elements, another set of vacuum assisted units is encountered by the underside of the forming fabric 105. These table elements are the Vaculine elements which are equipped with adjustable angle foil blades. Again, as the angle of the foil blades is increased, the drainage rate will increase until a consistency of 5% is achieved.

In addition to controlling drainage, the adjustable angle and height foil blades in the previously described drainage units also control turbulence within the wet slurry. This is accomplished through deflection of the forming fabric from its original plane as it travels along the top surface of the adjustable angle foil blades and adjustable height foil blades. This deflection creates a series of accelerations within the stock slurry that results in turbulence and shear within the stock slurry. This turbulence keeps the fibers fluidized and mobile within the wet slurry so that they can be orientated in the cross-machine or machine direction, depending on what the finish paper property strength requirements are.

For example, if machine direction fiber orientation is desired, the headbox jet speed is operated in a rush or drag mode to promote an initial strong machine direction alignment of the paper fibers. From here, the foil blade angles and height, along with the vacuum levels on the vacuum assisted dewatering units are adjusted to produce a high early drainage rate in the initial sheet dewatering zone (0.1% to 2% paper dryness) to immediately freeze the machine direction fiber orientation produced by the headbox.

In addition to this, the foil blade angles, heights and vacuum levels are adjusted to produce a high amount of turbulence in this paper dryness zone (0.1% to 2%). This keeps the fibers from entangling with each other and allows the headbox shear to become more effective in orientating fibers in the machine direction. After 2% paper dryness, the angle and height and vacuum levels are adjusted to gradually achieve a paper dryness of 5%. However, the foil angle and height are adjusted to achieve only moderate turbulence levels to prevent disruption of the machine direction fiber orientation achieved earlier in the sheet dewatering and forming process.

For cross-machine direction fiber alignment, the process is completely reversed. The headbox stock jet is adjusted to produce a speed difference close to zero (square mode) to promote the highest possible cross-machine direction fiber orientation. However, due to friction created within the headbox nozzle, a certain unavoidable degree of machine direction fiber alignment is still always present in the fiber slurry when it lands on the dewatering fabric that cannot be reversed through normal fourdrinier dewatering equipment.

To break this natural machine direction fiber orientation up and produce the most random fiber orientation and highest amount of cross-machine direction fiber orientation, the claimed invention is operated as follows. First, the foil blade angles and heights along with the vacuum levels of the vacuum assisted dewatering elements are adjusted to significantly retard drainage in the early sheet forming zone (0.1% to 2% dryness). This is completely opposite of the previously described process. In addition to this, the angle height of the foil blades are adjusted to produce a very high degree of turbulence to prevent fiber entanglement and generate the most random fiber orientation possible for the highest level of cross-machine direction fiber alignment. After a dryness of 2% is achieved, the foil angle and height is adjusted to maintain this high level of turbulence all the way until a paper dryness of 5% is achieved. A very gentle early drainage along with high turbulence all the way until a dryness of 5% is achieved will create the most random fiber network resulting in the highest amount of cross-machine direction fiber alignment.

Figure 3:
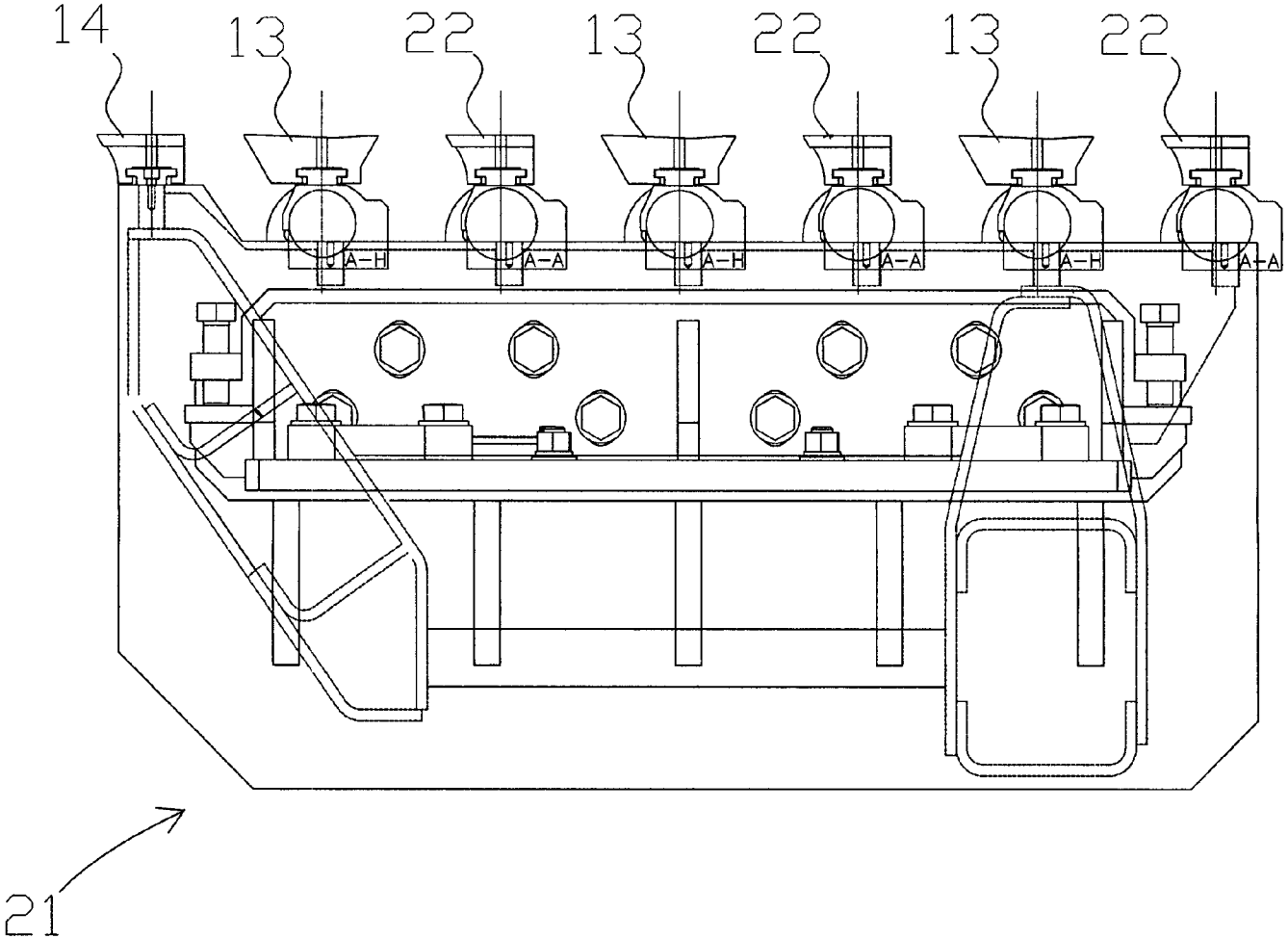
FIG. 3 shows a Hydroline element with adjustable angle and height foil blades and which forms part of the hydrofoil section of the Fourdrinier.
Figure 8A:
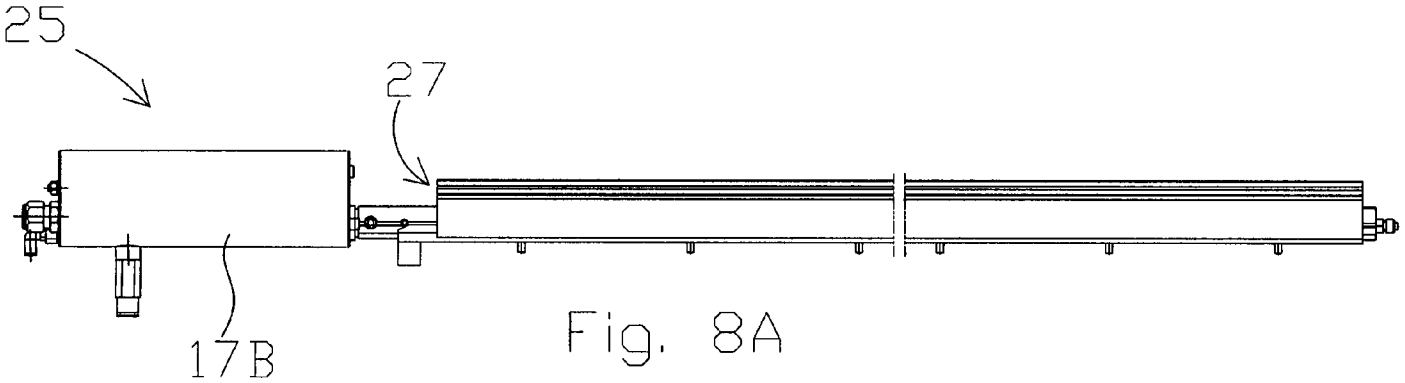
FIG. 8A shows a control subassembly for an angle adjustable blade taken from an end of the Fourdrinier.

After passing through the forming board section, the paper stock is moved along to pass through a hydrofoil or gravity section 20 equipped with Hydroline elements 21. Each Hydroline element 21 comprises height adjustable blades 13 and angle adjustable blades 22 which are alternately arranged as shown in FIG. 3. Depending on the paper grade, Hydrolines may also be fixed with all height or angle adjustable blades. The angle adjustable blades are controlled through an angle adjustment mechanism 25, 27 as shown in FIG. 8A. Height adjustable blades are controlled through a height adjustment mechanism 18, 21 as shown in FIG. 9B.

Figure 4:
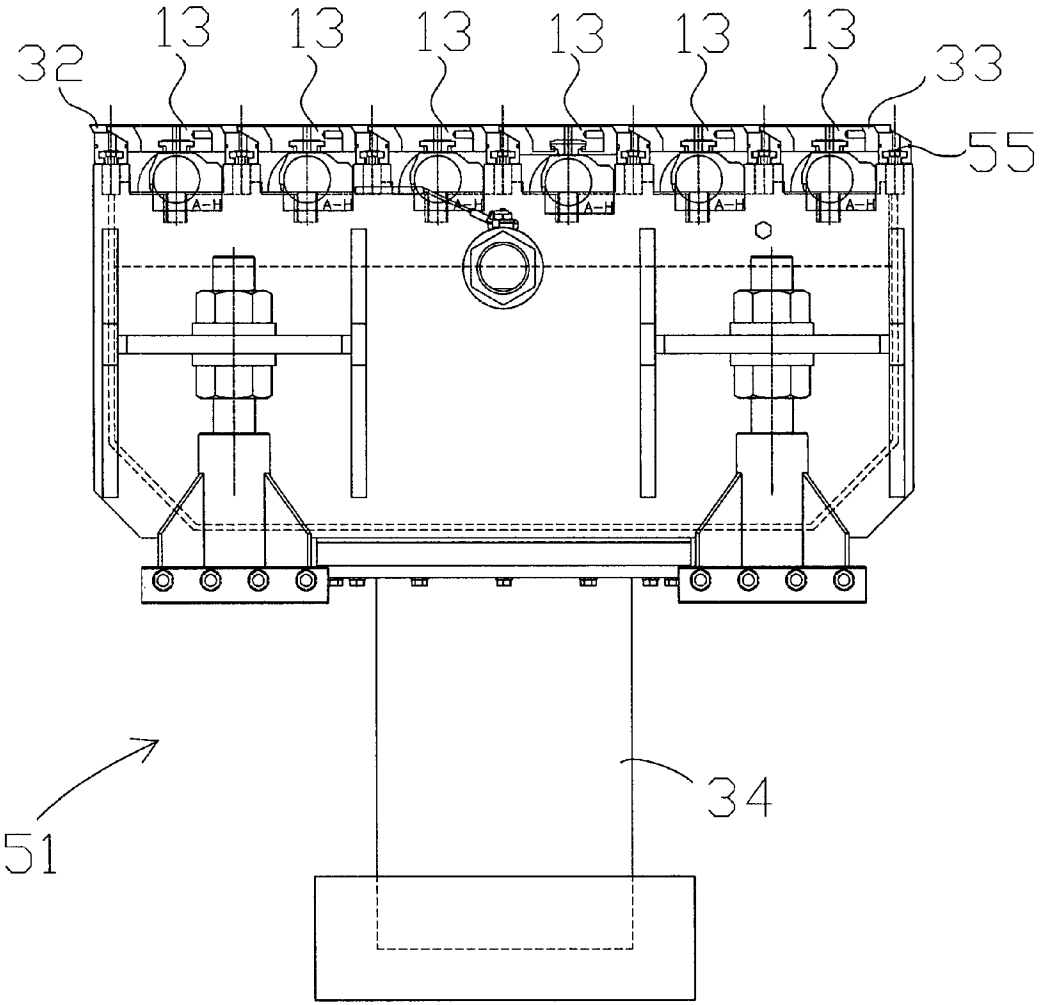
FIG. 4 shows a Varioline element with stationary and adjustable height foil units and being part of the low-vacuum section.

FIG. 4 depicts a vacuum assisted unit or Varioline table element 51 with stationary or angle adjustable foil blades and adjustable height blades and being part of the low-vacuum section. The Varioline element 51 comprises a dewatering blade 32 followed by height adjustable blades 13. A deckle is arranged blades and may comprise a poly material. A drop leg 34 extends down from the Varioline for draining purposes.

Figure 5:
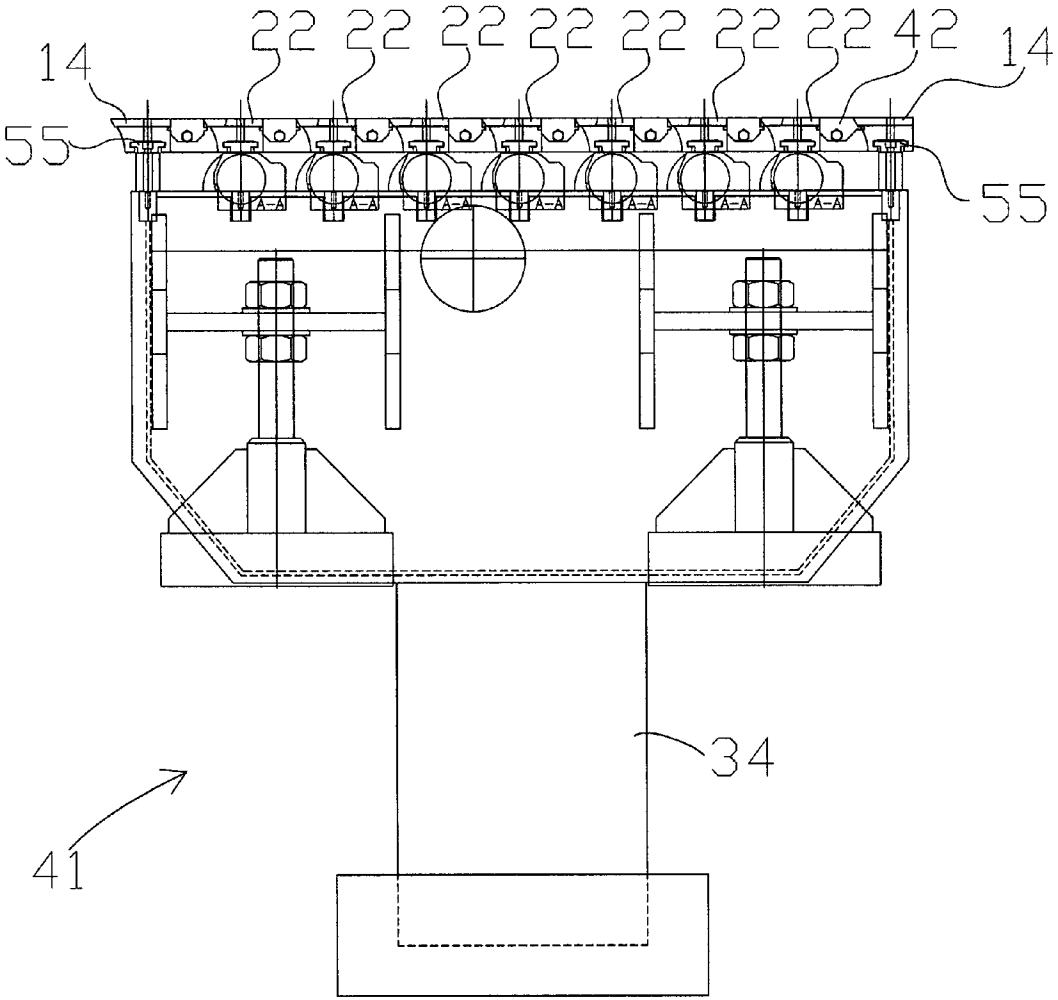
FIG. 5 shows a Vaculine element with stationary and angle adjustable foil blades and being part of the low-vacuum section.

FIG. 5 shows a Vaculine element 41 that is part of the low-vacuum section 30. Vaculine elements 41 are arranged downstream from the last Varioline element 51. Each Vaculine element includes a fixed blade 14 arranged on stationary T-bar 55 at the front and back ends as shown. Adjustable angle blades 22 are arranged in the Vaculine element. Adjustable deckles are interposed between the fixed blades 14 and the adjustable angle blades 22 as shown. A drop leg 34 extends downward for draining purposes.

Figure 6C:
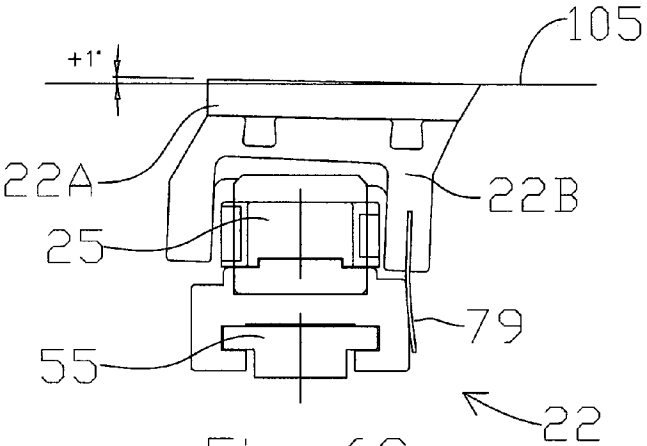
FIG. 6C shows a detailed view of an adjustable height foil blade mounted on a T-bar and with the leading edge of the angle adjustable blade raised to +1°.
Figure 6A:
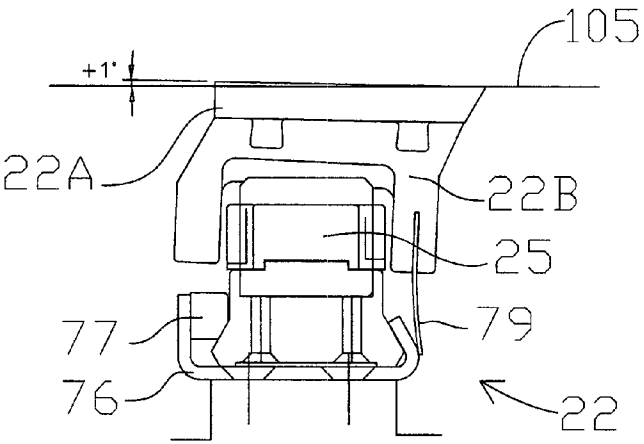
FIG. 6A shows a detailed view of an adjustable angle foil blade mounted on a C-channel and with the leading edge of the angle adjustable blade raised to +1°.
Figure 6D:
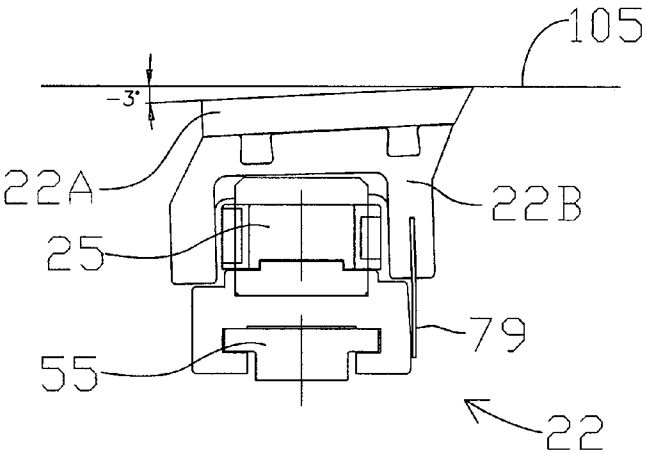
FIG. 6D shows the blade of FIG. 6C having a −3° separation from an underside of the forming fabric.
Figure 6B:
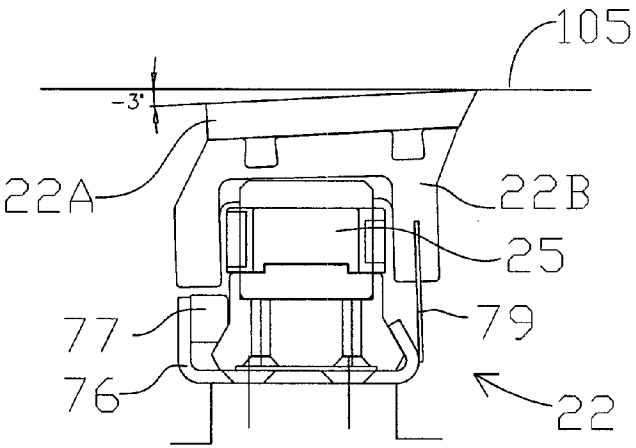
FIG. 6B shows the blade of FIG. 6A having a −3° separation from an underside of the forming fabric.

FIGS. 6A, 6B show a detailed view of an adjustable angle blade mounted on a C-channel. Blade 22 comprises a ceramic top 22A having a yoke 22B formed of fiberglass reinforced composite and having an offset front side as shown. The yoke 22B is fitted atop an adjusting mechanism 25. An underside of the angle adjusting mechanism 25 is secured within C-channel 76 via clamping bar 77. Protective shield 79 is provided on the blade 22 to prevent items from being caught when the adjustment mechanism 25 is actuated. The C-channel is preferably formed from stainless steel and rests atop the frame of the Fourdrinier.

FIGS. 6C, 6D show a detailed view of an adjustable angle blade mounted on a T-bar. In this instance, the mounting means is a T-bar 55 instead of the C-channel and clamping bar of FIGS. 6A, 6B. The adjustment mechanism and remaining parts are the same and operate in similar fashion. The respective angles and their range are also the same.

Figure 7A:
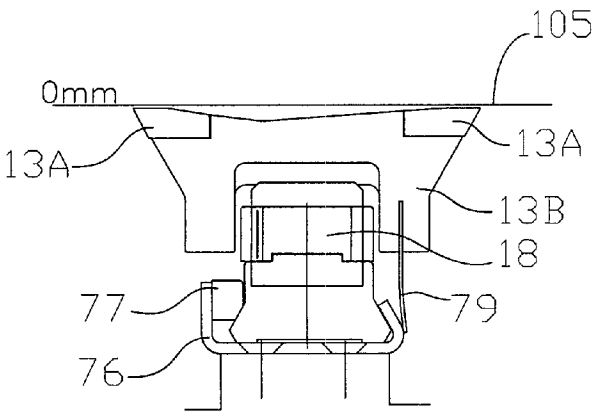
FIG. 7A shows a detailed view of an adjustable height activity blade mounted on a C-channel and with the height being at 0 mm where it is in contact with the underside of the forming fabric.
Figure 7B:
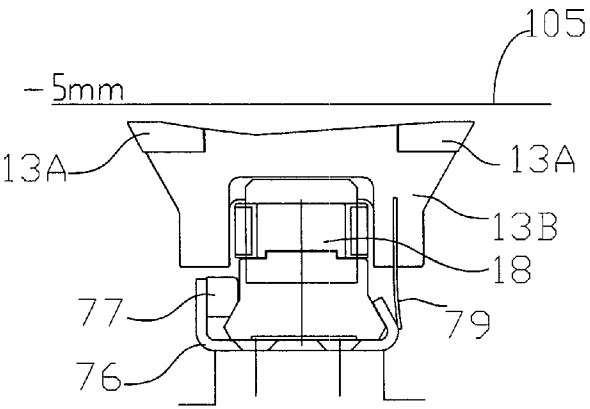
FIG. 7B shows the blade of FIG. 7A at a −5 mm height below the forming fabric.

FIGS. 7A, 7B show a detailed view of an adjustable height blade mounted on a C-channel. Height adjustable blade 13 includes an upper end having a leading and trailing edge of ceramic 13A which is fixed in a yoke 13B preferably formed of fiberglass reinforced composite. A height adjustment mechanism 18 is arranged within the yoke 13B. An underside of the height adjusting mechanism 18 is secured within C-channel 76 via clamping bar 77. Protective shield 79 is provided on the blade 13 to prevent items from being caught when the height adjustment mechanism 18 is actuated. The C-channel is preferably formed from stainless steel and rests atop the frame of the Fourdrinier. The height adjustment mechanism 18 includes an adjustable T-bar 21 which extends across the Fourdrinier frame and onto which the blade 13 is attached as shown FIG. 9A. In this manner, the drive 17A raises and lowers the T-bar 21 to adjust the height of the blade 13 in relation to an underside of the forming fabric 105.

Figure 7C:
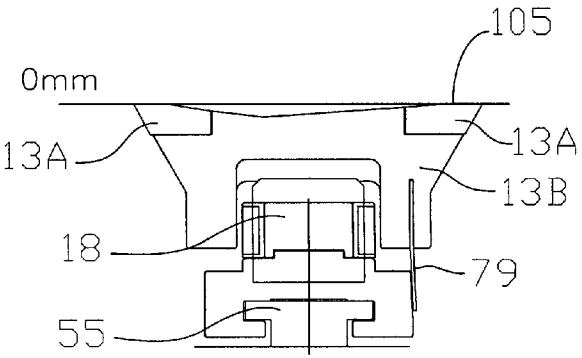
FIG. 7C shows a detailed view of an adjustable height blade mounted on a T-bar and with the height being at 0 mm where it is in contact with the underside of the forming fabric.
Figure 7D:
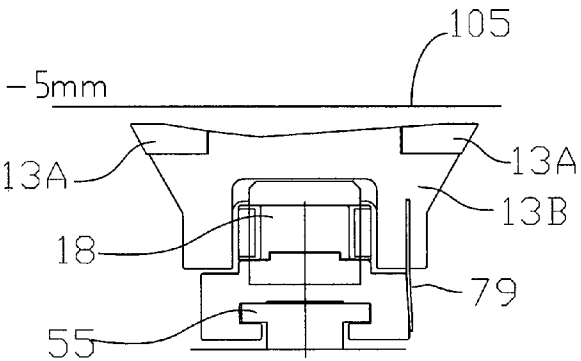
FIG. 7D shows the blade of FIG. 7C at a −5 mm height below the forming fabric.

FIGS. 7C, 7D shows a detailed view of an adjustable height foil blade mounted on a T-bar. In this instance, the mounting means is a T-bar instead of the C-channel and clamping bar of FIGS. 7A, 7B. The adjustment mechanism is the same and operates in similar fashion. The respective heights and their range are also the same.

Figure 8B:
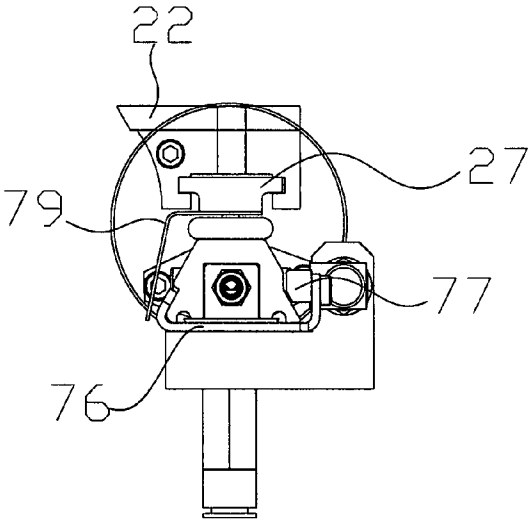
FIG. 8B shows a cutaway view of the drive that is actuated to adjust the angle of a respective blade.

FIGS. 8A, 8B shows an angle adjustment mechanism 25 which is a control subassembly for an angle adjustable blade 22. A rotating T-bar 27 is formed from fiber reinforced composite and is the same length as a substructure upon which it is mounted. The angle adjustment mechanism 25 is secured atop a C-channel. The drive 17B is indexed to rotate blade 22 over the range of angles shown in FIGS. 6A-D. The blade 22 is attached to the top side of T-bar 27 which is arranged to rotate in a clockwise or counter clockwise direction. In this manner, the angle of the blade 22 relative to the underside of the forming fabric is controlled.

Figure 9A:
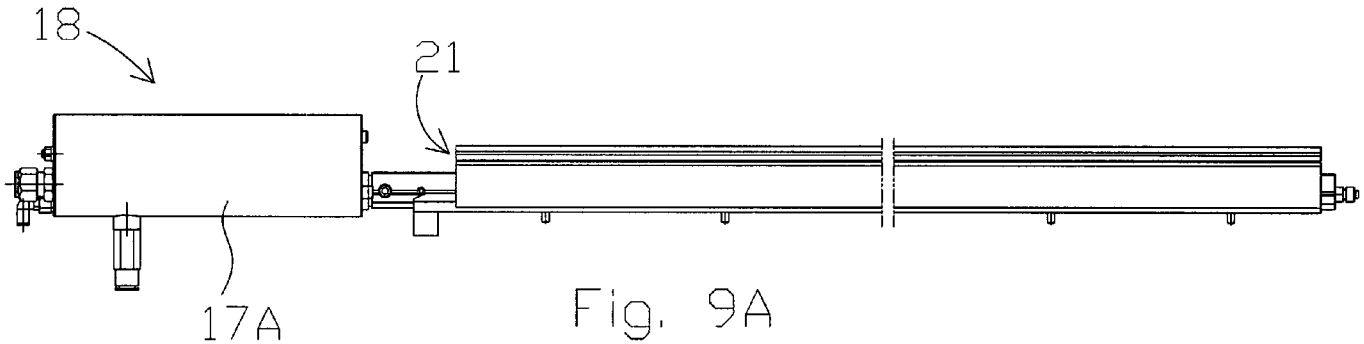
FIG. 9A shows a control subassembly for the height adjustable blade taken from an end of the Fourdrinier.
Figure 9B:
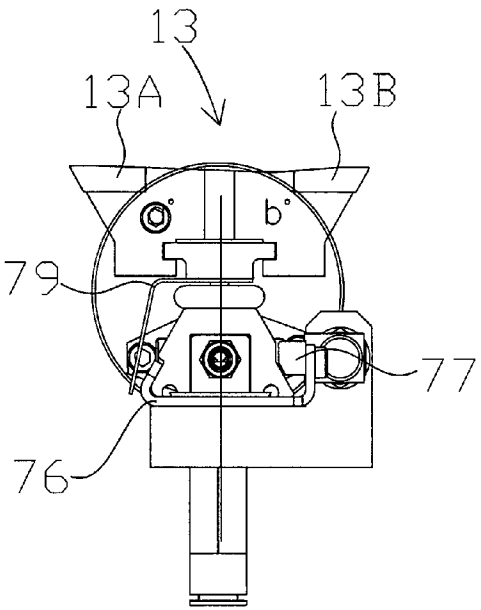
FIG. 9B shows a cutaway view of the drive that is actuated to adjust the height of a respective blade.

FIGS. 9A, 9B shows a height adjustment mechanism 78 which is a control subassembly for the height adjustable blade 13. Blade 13 rests atop a T-bar having a drive 17A that automatically raises and lowers the blade 13 to a desired height.

Tables 1 and 2 show blade angle and height settings for a paper grade with machine direction fiber alignment and a grade with cross-machine direction fiber alignment. The tables show a variety of angle adjustable and height adjustable blades which may be utilized in the respective regions of the wet end of the Fourdrinier to achieve synergistic results. It should be noted that in this instance seven blades are shown in each section with the abbreviations "H" or "A" indicating that the blade is either height or angle adjustable respectively. Moreover, the gravity units 1-3 correspond to the hydrofoil sections and are three Hydroline elements. Low vacuum units 1-3 correspond to Varioline elements. Low vacuum units 4, 5 correspond to Vaculine elements.

TABLE 1

Machine Direction Fiber Alignment

| Blade | | Forming Board | | Gravity Unit 1 | | Gravity Unit 2 | | Gravity Unit 3 | | Low Vacuum Unit 1 | | Low Vacuum Unit 2 | | Low Vacuum Unit 3 | | Low Vacuum Unit 4 | | Low Vacuum Unit 5 |
|---|---|---|---|---|---|---|---|---|---|---|---|---|---|---|---|---|---|---|
| 1 | H | −0.25 mm | A | −1.5° | H | −0.5 mm | A | −1.5° | H | −0.5 mm | H | −0.5 mm | H | −0.5 mm | A | −0.75° | A | −0.0° |
| 2 | A | −0.25° | H | −0.5 mm | A | −1.5° | H | −0.5 mm | H | −0.5 mm | H | −0.5 mm | H | −0.5 mm | A | −0.75° | A | −0.0° |
| 3 | H | −0.25 mm | A | −1.5° | H | −0.5 mm | A | −1.5° | H | −0.5 mm | H | −0.5 mm | H | −0.5 mm | A | −0.75° | A | −0.0° |
| 4 | A | −0.25° | H | −0.5 mm | A | −1.5° | H | −0.5 mm | H | −0.5 mm | H | −0.5 mm | H | −0.5 mm | A | −0.75° | A | −0.0° |
| 5 | H | −0.25 mm | A | −1.5° | H | −0.5 mm | A | −1.5° | H | −0.5 mm | H | −0.5 mm | H | −0.5 mm | A | −0.75° | A | −0.0° |
| 6 | A | −0.25° | H | −0.5 mm | A | −1.5° | H | −0.5 mm | H | −0.5 mm | H | −0.5 mm | H | −0.5 mm | A | −0.75° | A | −0.0° |
| 7 | H | −0.25 mm | A | −1.5° | H | −0.5 mm | A | −1.5° | H | −0.5 mm | H | −0.5 mm | H | −0.5 mm | A | −0.75° | A | −0.0° |

TABLE 2

Cross-machine Direction Fiber Alignment

| Blade | | Forming Board | | Gravity Unit 1 | | Gravity Unit 2 | | Gravity Unit 3 | | Low Vacuum Unit 1 | | Low Vacuum Unit 2 | | Low Vacuum Unit 3 | | Low Vacuum Unit 4 | | Low Vacuum Unit 5 |
|---|---|---|---|---|---|---|---|---|---|---|---|---|---|---|---|---|---|---|
| 1 | H | −0.0 mm | A | −0.0° | H | −0.0 mm | A | −0.5° | H | −1.0 mm | H | −1.25 mm | H | −1.5 mm | A | −1.5° | A | −2.0° |
| 2 | A | −0.0° | H | −0.0 mm | A | −0.25° | H | −0.0 mm | H | −1.0 mm | H | −1.25 mm | H | −1.5 mm | A | −1.5° | A | −2.0° |
| 3 | H | −0.0 mm | A | −0.0° | H | −0.0 mm | A | −0.5° | H | −1.0 mm | H | −1.25 mm | H | −1.5 mm | A | −1.5° | A | −2.0° |
| 4 | A | −0.0° | H | −0.0 mm | A | −0.25° | H | −0.0 mm | H | −1.0 mm | H | −1.25 mm | H | −1.5 mm | A | −1.5° | A | −2.0° |
| 5 | H | −0.0 mm | A | −0.0° | H | −0.0 mm | A | −0.5° | H | −1.0 mm | H | −1.25 mm | H | −1.5 mm | A | −1.5° | A | −2.0° |
| 6 | A | −0.0° | H | −0.0 mm | A | −0.25° | H | −0.0 mm | H | −1.0 mm | H | −1.25 mm | H | −1.5 mm | A | −1.5° | A | −2.0° |
| 7 | H | −0.0 mm | A | −0.0° | H | −0.0 mm | A | −0.5° | H | −1.0 mm | H | −1.25 mm | H | −1.5 mm | A | −1.5° | A | −2.0° |

It is to be understood that the invention is not limited to the exact construction illustrated and described above, but that various changes and modifications may be made without departing from the spirit and the scope of the invention as defined in the following claims. While the invention has been described with respect to preferred embodiments, it is intended that all matter contained in the above description or shown in the accompanying drawings shall be interpreted as illustrative and not in limiting sense. From the above disclosure of the general principles of the present invention and the preceding detailed description, those skilled in the art will readily comprehend the various modifications to which the present invention is susceptible. Therefore, the scope of the invention should be limited only by the following claims and equivalents thereof.

We claim:

1. A paper making process of producing paper having machine direction aligned fibers, said process comprising:

operating a forming fabric of a Fourdrinier machine in a rush mode or a drag mode to promote an initial machine direction alignment of paper fibers within a paper web deposited onto the forming fabric;

adjusting angles of angle adjustable blades and adjusting heights of height adjustable blades along with vacuum levels on vacuum assisted dewatering units in an initial sheet dewatering zone to produce an early drainage rate so that the paper web has a consistency in the initial sheet dewatering zone within a range of 0.1% to 2% to immediately freeze the machine direction alignment of paper fibers and to produce turbulence so that the paper fibers are kept mobile and entanglement is prevented; and adjusting foil blade angles and heights and vacuum levels after the initial sheet dewatering zone to gradually achieve a consistency of 5%;

wherein the foil blades angles and heights are adjusted after the initial sheet dewatering zone to create moderate turbulence levels and prevent disruption of the machine direction fiber orientation achieved in the initial sheet dewatering zone.

2. The paper making process of claim 1, wherein the foil blades that are height adjustable and the foil blades that are angle adjustable are alternatingly arranged.

3. The paper making process of claim 1, wherein the foil blades that are angle adjustable can be varied between an angle of +2 degrees and −4 degrees.

4. The paper making process of claim 1, wherein during the step of adjusting the height of the height adjustable foil blades the height adjustable foil blades are set at a setting of 0 mm so that the height adjustable foil blades are in the same plane as the forming fabric and the height of the height adjustable foil blades are lowered from the fabric so that the amount of drainage increases.

5. The paper making process of claim 1, wherein each height adjustable blade comprises a height adjustment control mechanism and that includes an adjustable T-bar which extends across the frame and having a drive that raises and lowers the adjustable T-bar to adjust the height of the blade in relation to the underside of the forming fabric.

6. The papermaking process of claim 1, wherein each of said angle adjustable blades comprise an angle adjustment mechanism arranged therein, an underside of the angle adjustment mechanism being secured to a frame and said angle adjustment mechanism includes an adjustable T-bar that extends across the frame of the Fourdrinier machine, said angle adjustment mechanism including a drive that rotates a leading edge of the angle adjustable blade over a range of angles.

7. A paper making process of producing paper having fibers that are cross machine direction aligned, said process comprising:

operating a forming fabric of a Fourdrinier machine in a square mode to promote an initial cross-machine direction alignment of the paper fibers;

adjusting foil blade angles and foil blade heights along with vacuum levels of vacuum assisted dewatering elements in an early sheet forming zone to substantially retard drainage in the early sheet forming zone so that a paper web has a consistency within a range of 0.1% to 2%, wherein the angle and height of the foil blades are adjusted to produce a turbulence to prevent the filers from entangling and to generate random orientation of the fibers so that the fibers have the cross-machine direction fiber alignment; and wherein after a consistency of 2% is achieved in the early sheet forming zone, the foil blades' angles and heights are adjusted in a second zone to maintain a high level of turbulence until a consistency of 5% is achieved;

wherein an early drainage is sustained in the paper web along with the high level of turbulence until a consistency of 5% is achieved so that the cross-machine direction fiber alignment is created.

8. The paper making process of claim 7, wherein the foil blades that are height adjustable and the foil blades that are angle adjustable are alternatingly arranged.

9. The paper making process of claim 7, wherein the foil blades that are angle adjustable can be varied between an angle of +2 degrees and −4 degrees.

10. A method of creating paper by actively controlling the orientation of fibers at a wet end of a Fourdrinier, said method comprising:

providing a forming board section a forming board section including a formline element that comprises:

three fixed blades and three height adjustable blades which are arranged alternately with the three fixed blades, wherein said three height adjustable blades each include a control subassembly that controls a height of each respective height adjustable blade relative to an underside of a forming fabric;

providing a hydrofoil section having:

a fixed blade, three angle adjustable blade, and three height adjustable blades alternatively arranged with the three angle adjustable blades, said three height adjustable blades each including a control subassembly that controls a height of each respective height adjustable blade relative to the underside of the forming fabric; and providing a low-vacuum section comprising:

at least one vacuum assisted foil unit and at least one vacuum unit, wherein said at least one vacuum assisted foil unit comprise:

one fixed blade and six adjustable height blades, in said six height adjustable blades each include:

a control subassembly that controls a height of each respective height adjustable blade relative to the underside of the forming fabric, wherein said at least one vacuum unit comprises seven angle adjustable blades sandwiched by two fixed blades, said seven adjustable angle blades each including a control subassembly that controls an angle of a respective blade relative to the underside of the forming fabric;

operating the forming fabric of the Fourdrinier machine in a rush or drag mode to promote an initial machine direction alignment of paper fibers within a paper web deposited onto the forming fabric or in a square mode to promote an initial cross machine direction alignment of the paper fibers, adjusting blade angles and heights along with vacuum levels on vacuum assisted dewatering units to produce a drainage rate so that the paper web has a consistency in an initial sheet dewatering zone within a range of 0.1% to 2%, wherein the blades are adjusted so that the blade angles produce turbulence to keep the paper fibers mobile and prevent entanglement of the paper fibers in the paper web, and adjusting blade angles and heights and vacuum levels after the initial sheet dewatering zone to gradually achieve a consistency of 5%; and wherein the blades' angles and heights are adjusted to create turbulence levels which prevent disruption of the machine direction fiber orientation achieved in the initial sheet dewatering zone.

11. The paper making process of claim 10, wherein the foil blades that are angle adjustable can be varied between an angle of +2 degrees and −4 degrees.

12. The paper making process of claim 10, wherein each height adjustable blade comprises a height adjustment control mechanism and that includes an adjustable T-bar which extends across the frame and having a drive that raises and lowers the adjustable T-bar adjust the height of the blade in relation to the underside Of the forming fabric.

13. The papermaking process of claim 10, wherein each of said angle adjustable blades comprise an angle adjustment mechanism arranged therein, an underside of the angle adjustment mechanism being secured to a frame and said angle adjustment mechanism includes an adjustable T-bar extends across the frame of the Fourdrinier machine, said angle adjustment mechanism including a drive that rotates a leading edge of the angle adjustable blade over a range of angles.

* * * * *

UNITED STATES PATENT AND TRADEMARK OFFICE

CERTIFICATE OF CORRECTION

PATENT NO. : 8,551,293 B2
APPLICATION NO. : 13/506470
DATED : October 8, 2013
INVENTOR(S) : Faufau et al.

It is certified that error appears in the above-identified patent and that said Letters Patent is hereby corrected as shown below:

In the Claims:

Claim 1, Column 11, Line 35, delete “blades”, insert --blades’--
Claim 7, Column 12, Line 2, delete “cross machine”, insert --cross-machine--
Claim 7, Column 12, Line 13, delete “filers”, insert --fibers--
Claim 10, Column 12, Line 47, delete “blade”, insert --blades--
Claim 10, Column 12, Line 57 & 58, delete “com-prise”, insert --com-prises--
Claim 10, Column 12, Line 60, delete “in”, insert --wherein--
Claim 10, Column 13, Line 8, delete “cross machine”, insert --cross-machine--
Claim 12, Column 14, Line 11, insert --to-- between “T-bar” and “adjust”
Claim 12, Column 14, Line 12, delete “Of”, insert --of--
Claim 13, Column 14, Line 17, insert --that-- after “adjustable T-bar”

Signed and Sealed this
Nineteenth Day of November, 2013

Teresa Stanek Rea

Teresa Stanek Rea
*Deputy Director of the United States Patent and Trademark Office*